US012601082B2

(12) United States Patent
Crema

(10) Patent No.: US 12,601,082 B2
(45) Date of Patent: Apr. 14, 2026

(54) METHOD OF PROCESSING ARTICLES AND CORRESPONDING APPARATUS

(71) Applicant: STMICROELECTRONICS S.r.l., Agrate Brianza (IT)

(72) Inventor: Paolo Crema, Vimercate (IT)

(73) Assignee: STMICROELECTRONICS S.r.l., Agrate Brianza (IT)

( * ) Notice: Subject to any disclaimer, the term of this patent is extended or adjusted under 35 U.S.C. 154(b) by 0 days.

(21) Appl. No.: 18/496,643

(22) Filed: Oct. 27, 2023

(65) Prior Publication Data

US 2024/0141543 A1 May 2, 2024

(30) Foreign Application Priority Data

Nov. 2, 2022 (IT) ..... 102022000022455

(51) Int. Cl.
*C25D 21/04* (2006.01)
*C25D 7/12* (2006.01)
*C25D 17/00* (2006.01)

(52) U.S. Cl.
CPC ..... *C25D 21/04* (2013.01); *C25D 7/12* (2013.01); *C25D 17/001* (2013.01); *C25D 17/002* (2013.01)

(58) Field of Classification Search
CPC ..... C25D 21/04; C25D 7/12; C25D 17/001; C25D 17/002; C25D 5/00; C25D 21/00; C25D 21/12; C25D 21/10
See application file for complete search history.

(56) References Cited

U.S. PATENT DOCUMENTS 6,162,726 A * 12/2000 Dubin ..... C25D 5/003 438/782
2010/0200067 A1 8/2010 Liu et al.
2021/0167022 A1* 6/2021 Crema ..... H01L 23/49582

FOREIGN PATENT DOCUMENTS

GB 2071155 A 9/1981
WO WO 2018003620 A1 1/2018

* cited by examiner

*Primary Examiner* — Dah-Wei D. Yuan
*Assistant Examiner* — Nga Leung V Law
(74) *Attorney, Agent, or Firm* — Seed Intellectual Property Law Group LLP

(57) ABSTRACT

Articles such as substrates for semiconductor products comprising metal and resin portions with adhesion promoter material are processed in a plating bath, wherein the adhesion promoter material is exposed to dissolution as a result of prolonged exposure to the plating bath. The articles are processed by dipping them in the processing bath so that they have opposed surfaces exposed to the processing bath.

The movement of the articles through the processing bath B may occur to be halted. In that case a gas flow is provided lapping the opposed surfaces of the articles to shield the opposed surfaces of the articles from exposure to the processing bath.

13 Claims, 3 Drawing Sheets

METHOD OF PROCESSING ARTICLES AND CORRESPONDING APPARATUS

BACKGROUND

Technical Field

The description relates to processing articles via a processing bath.

Solutions as described herein can be advantageously applied in plating equipment used in manufacturing semiconductor devices, for instance.

Description of the Related Art

Various processes of manufacturing semiconductor devices comprise a step where, after molding a resin, leadframes are plated in an acidic solder plating bath which may contain wetting agents.

An adhesion promoter can be provided on the leadframes in order to enhance adhesion between the molding material (e.g., resin) and the leadframe material (e.g., metal).

It is noted that adhesion promoters (silver oxide, for instance) may be soluble in an acidic bath when the pH is lower than 3; this causes the solder plating bath to dissolve the adhesion promoter if leadframes resides for a long period (e.g., 10-15 minutes) in the solder plating bath.

Such an extended time in the chemical bath may result in delamination issues which represent a weakness in process such as the process currently referred to as Non-Etching-Adhesion-Promoter, NEAP.

BRIEF SUMMARY

Solutions as described herein aim at addressing the issues discussed in the foregoing.

Such an object can be achieved via a method having the features set forth in the claims that follow.

One or more embodiments relate to a corresponding equipment.

The claims are an integral part of the technical teaching provided in respect of the embodiments.

Solutions as described herein are based on a tool/equipment configured to protect an article being processed in case of (temporary) tool/equipment stops.

Solutions as described herein include nozzles configured to form, during an equipment stop, protective gas bubble curtains that counter prolonged contact of articles being processed (e.g., leadframes for semiconductor devices) with a processing bath (e.g., a solder plating bath).

Solutions as described herein involve providing a curtain of inert gas (e.g., N2) to counter the renewal of the bath at the surface of the articles.

Solutions as described herein can be applied, in general, to various types of tools/equipment wherein articles being treated are moved (e.g., advanced) through a processing (e.g., electrochemical) bath and a possible halt of the movement (motion) may undesirably result in the articles being left in prolonged contact with the bath.

BRIEF DESCRIPTION OF THE SEVERAL VIEWS OF THE DRAWINGS

One or more embodiments will now be described, by way of example only, with reference to the annexed figures, wherein.

Corresponding numerals and symbols in the different figures generally refer to corresponding parts unless otherwise indicated.

The figures are drawn to clearly illustrate the relevant aspects of the embodiments and are not necessarily drawn to scale.

The edges of features drawn in the figures do not necessarily indicate the termination of the extent of the feature.

DETAILED DESCRIPTION

In the ensuing description one or more specific details are illustrated, aimed at providing an in-depth understanding of examples of embodiments of this description. The embodiments may be obtained without one or more of the specific details, or with other methods, components, materials, etc. In other cases, known structures, materials, or operations are not illustrated or described in detail, so that certain aspects of embodiments will not be obscured.

Reference to "an embodiment" or "one embodiment" in the framework of the present description is intended to indicate that a particular configuration, structure, or characteristic described in relation to the embodiment is comprised in at least one embodiment. Hence, phrases such as "in an embodiment" or "in one embodiment" that may be present in one or more points of the present description do not necessarily refer to one and the same embodiment.

Moreover, particular conformations, structures, or characteristics may be combined in any adequate way in one or more embodiments.

The headings/references used herein are provided merely for convenience and hence do not define the extent of protection or the scope of the embodiments.

For simplicity and ease of explanation, throughout this description, and unless the context indicates otherwise, like parts or elements are indicated in the various figures with like reference signs, and a corresponding description will not be repeated for each and every figure.

Figure 1:
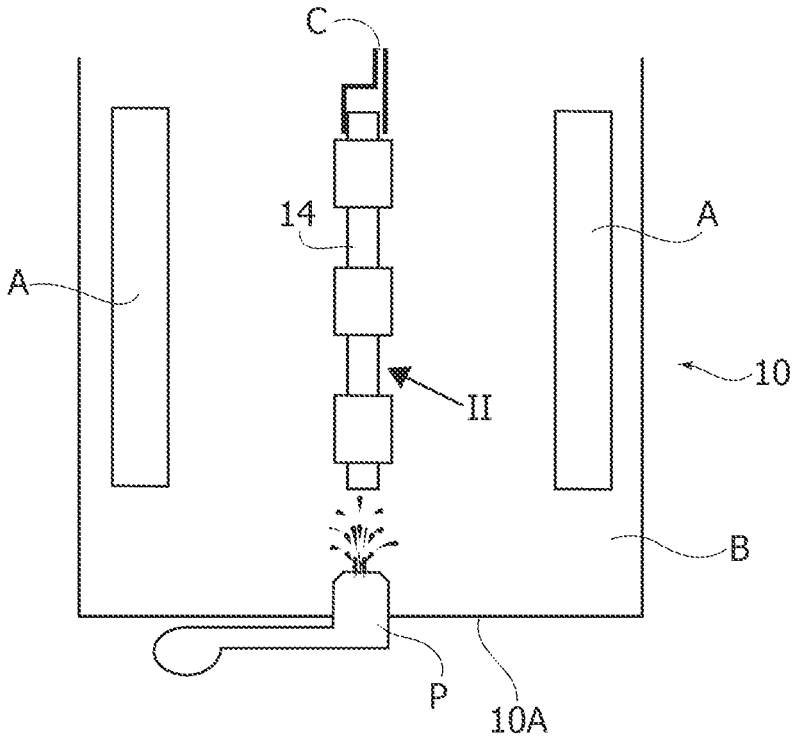
FIG. 1 is a cross-sectional view of a treatment vat wherein articles are treated in a bath contained in the vat.

FIG. 1 is a cross-sectional view of a (e.g., channel-like) treatment vat 10 along which articles 14 are moved—e.g., advanced in a direction orthogonal to the plane of the figure—to be treated in a (liquid) bath B contained in the vat 10.

In examples considered herein, the articles 14 are leadframes used in manufacturing semiconductor devices.

In current manufacturing processes of semiconductor devices, plural devices are manufactured concurrently on a leadframe strip to be separated into single individual device in a final singulation step.

FIG. 1 can thus be regarded a cross-sectional view of a treatment vat 10 along which such a leadframe strip 14 is moved (e.g., advanced) along its length—in a direction orthogonal to the plane of the figure—to be treated in the bath B contained in the vat 10.

Various types of semiconductor devices comprise (integrated circuit) semiconductor chips or dice mounted on a sculptured metallic substrate, referred to as leadframe.

The designation "leadframe" (or "lead frame") is currently used (see, for instance the USPC Consolidated Glossary of the United States Patent and Trademark Office) to indicate a metal frame that provides support for an integrated circuit chip or die as well as electrical leads to interconnect the integrated circuit in the die or chip to other electrical components or contacts.

After mounting the chip(s) or die/dice (these terms are used herein as synonymous) on a leadframe and providing electrically conductive formations coupling the chip or chips to leads in the leadframe, an insulating encapsulation (e.g., an epoxy resin) is molded on the assembly thus formed to complete the plastic body of the device.

In certain cases, a leadframe can be of the pre-molded type, that is a type of leadframe comprising a sculptured metal (e.g., copper) structure formed by etching a metal sheet and comprising empty spaces that are filled by a resin "pre-molded" on the sculptured metal structure.

In order to enhance adhesion between the metallic leadframe and the resin, an adhesion promoter layer may be advantageously provided therebetween.

The assembly formed is thus mounted/attached on a support member such as a printed circuit board (PCB). This can be done using solder material which can be deposited on the leadframe surface via electrolytic plating.

In electrolytic plating, an electric field is established in the bath B between anodes A and the leadframe strip 14, acting as a cathode C. In that way positively charged metal ions in the liquid bath B are forced to move to the cathode C where they give up their charge and deposit as metal on the surface of the leadframe strip 14.

A process as discussed so far is conventional in the art, which makes it unnecessary to provide a more detailed description herein.

It is otherwise noted that reference to a leadframe strip processed by dipping into and by being moved through a solder plating bath 14 is merely by way of example and shall not be construed in a non-limiting sense of the embodiments.

As noted, solutions as described herein can be applied, in general, to various types of tools/equipment wherein articles being treated are moved through a processing (liquid) bath and a possible halt of the movement may result in the articles being undesirably left in prolonged contact with the bath.

For instance, in the case illustrated in FIG. 1 a leadframe strip 14 after (pre)molding advances through a solder plating bath B in the vat 10. The solder plating bath B is an acidic medium containing wetting agents.

Adhesion promoters can be provided on the leadframes 14 in order to enhance adhesion between resin and metals. One such adhesion promoter is silver oxide, that is soluble in acidic media with a pH lower than 3.

A pump P facilitates the renewal of the acidic medium in contact with the leadframe strip 14. It is noted that such a solder bath may enter an "interface" and dissolve the adhesion promoter when leadframes reside (e.g., due to the leadframe movement being halted for any reasons) more then, e.g., 10-15 minutes in the chemical bath B.

As a consequence, an extended residence (e.g., 10-15 minutes) of the leadframe strip 14 in the plating bath B may cause the dissolution of the adhesion promoter layer, which may result in delamination. Such delamination issues may represent a weakness in the NEAP processes.

Figure 2:
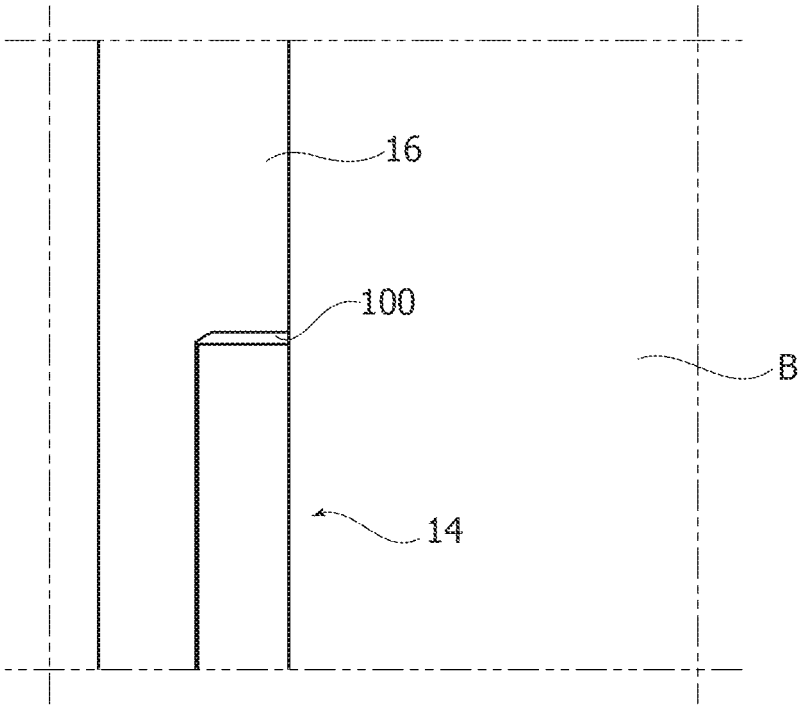
FIG. 2 is a view of the portion of FIG. 1 indicated by the arrow II, reproduced on an enlarged scale.

This situation is illustrated in FIG. 2; an adhesion promoter layer as indicated by 100 between the leadframe 14 and a molding material (resin) 16 may dissolve due to a prolonged exposure to the plating bath B.

In a current process the exposure time (that is, the plating time) may be about 3 minutes, thus not long enough to cause an undesired dissolution of the adhesion promoter layer.

If, for any reasons, the motion of the leadframe strip 14 through the bath B is halted (e.g., because the tool/equipment for solder plating is stopped) the leadframe strip 14 will be kept "dipping" in the plating bath B for long enough to produce undesired dissolution of the adhesion promoter layer 100.

A way of addressing that problem may involve countering the "renewal" of the liquid bath at the leadframe strip surface by turning off the pump P.

This method has the disadvantage of affecting the yield of the plating machine as the procedure to turn the pump on again may require a relatively long time.

Solutions as described in the following aim at effectively countering the detrimental effects of an undesired long immersion in the solder plating bath, which may cause delamination and failure of the device.

Figure 3A:
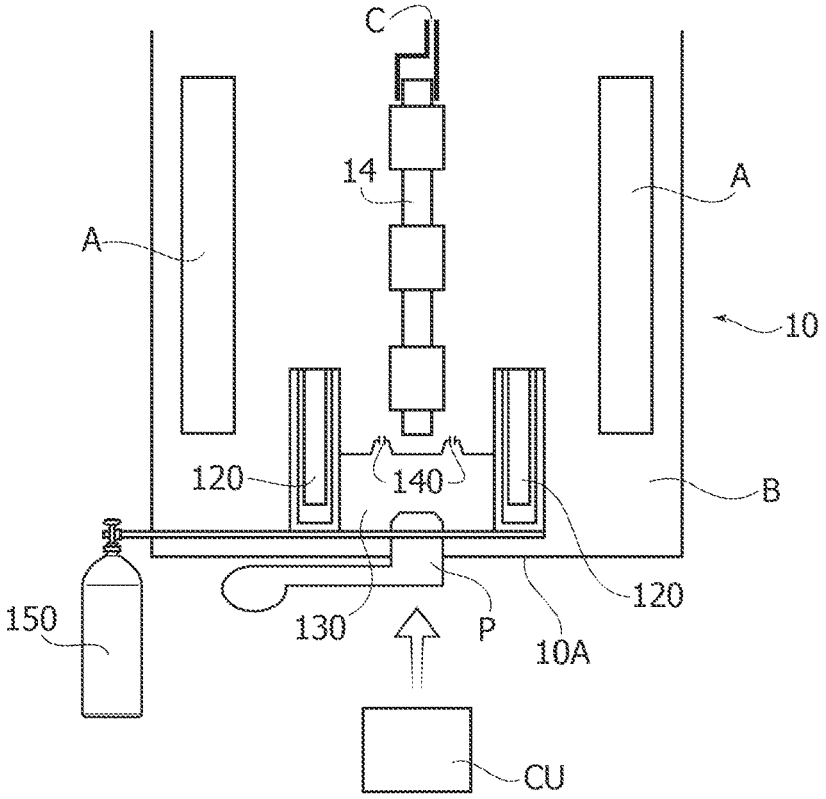
FIGS. 3A to 3C are cross-sectional views substantially corresponding to the cross-sectional view of FIG. 1, exemplary of possible steps in embodiments of the present description.
Figure 3B:
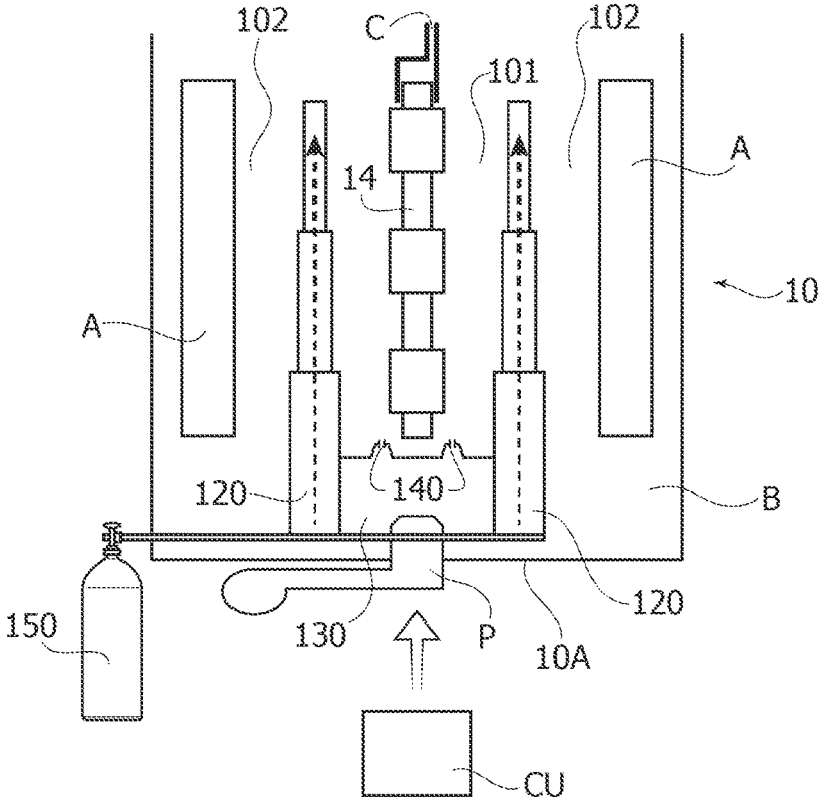
Figure 3C:
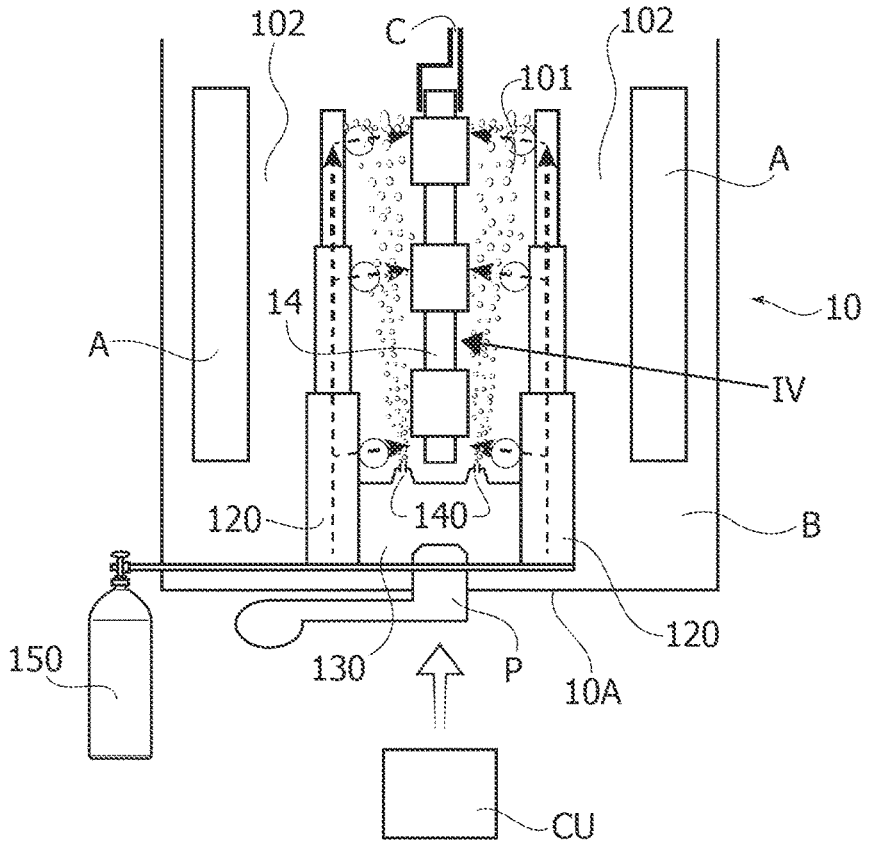

The sequence of FIGS. 3A to 3C is illustrative of possible configuration and operation of a solder plating tool/equipment according to embodiments as discussed herein.

It will be otherwise appreciated that the sequence of steps of FIGS. 3A to 3C is merely exemplary insofar as, for instance, additional steps may be added.

FIG. 3A is exemplary of a vat 10 intended to contain a solder plating bath B being equipped provided with motorized walls or baffles 120 that can be selectively brought (e.g., by being extended/retracted vertically) in:

- a first (here retracted or lowered) configuration as illustrated in FIG. 3A, and
- a second (here extended or raised) configuration as illustrated in FIGS. 3B (and 3C).

In the first configuration or position as illustrated in FIG. 3A, the baffles or walls 120 do not interfere appreciably with the bath B and its interaction with the leadframes 14.

In the second configuration or position as illustrated in FIG. 3B, the baffles or walls 120 define (on both sides of the leadframes 14) a compartment (cell) 101 of the inner volume of the vat 12.

That is, in the second configuration or position as illustrated in FIG. 3B, the baffles or walls 120 extend between the leadframe 14 and the anodes A in the processing bath B, thus somehow "embracing" (at a distance) the leadframes 14.

Stated otherwise, in the second configuration or position as illustrated in FIG. 3B, the baffles or walls 120 partition the inner volume of the vat 10 into:

- an inner compartment (secondary cell) 101 of the vat 12, wherein the leadframes 14 are located, and
- two external regions 102 (main outer cell) where the anodes A are located.

To summarize, in solutions as described herein, articles such as leadframes 14 are processed by dipping them into processing bath such as an acidic plating bath B.

The articles 14 have opposed surfaces configured to be exposed to the processing bath B and are moved (e.g., advanced) along the vat 10 through the processing bath B.

This may occur according to principles known to those of skill in the art (thus making it unnecessary to provide a more detailed description herein) under the control of a control unit CU (an industrial PC, for instance) that supervises operation of the (e.g., plating) apparatus.

As exemplified herein:

- the processed articles 14 are substrates (leadframes) for semiconductor products that comprise metal and resin portions with adhesion promoter material 100 therebetween (FIG. 2, for instance), and the processing bath B is a plating bath and the adhesion promoter material 100 is exposed to dissolution as a result of prolonged exposure to the plating bath B.

As noted, solutions as described herein can be applied, in general, to various types of tools/equipment wherein articles are treated with a processing (liquid) bath and a possible halt of the movement of the articles may result in the articles being undesirably left in prolonged contact with the bath.

In solutions as described herein, in response to the movement of the articles 14 along the vat 10 through the bath B being halted (this may be commanded by the control unit CU for various reasons), the control unit CU can activate (possibly with a delay, as discussed in the following) a gas source 150 (e.g., of an inert gas such as nitrogen) to provide a gas flow (e.g., in the form of bubbles) lapping the opposed surfaces of the articles 14. In that way the gas flow shields the opposed surfaces from undesired prolonged exposure to the processing bath B.

The gas flow lapping the opposed surfaces of the articles 14 results in—here upward—flow of bubbles of (inert) gas along and notionally over (against) the opposed surfaces of the articles 14, that are thus shielded and protected from the processing bath B.

In solutions as described herein, in response to the movement of the articles 14 through the bath B being halted, partitioning walls 120 of the processing bath B are deployed.

With the partitioning walls 120 deployed, the inner volume of the vat 10 (and the processing bath B therein) are partitioned in a first cell 102 lying outwardly of the deployed partitioning walls 120 and a second cell 101 lying inwardly of the deployed partitioning walls 120 so that the articles 14 lie in the second cell 101 of the processing bath B.

In solutions as described herein, the gas flow lapping the opposed surfaces of the articles 14 is provided within the second cell 101 of the processing bath B.

As noted, the control unit CU can be configured in such a way that the source 150 of the gas flow lapping the opposed surfaces of the articles 14 is activated with a delay with respect to the movement of the articles 14 being halted.

In solutions as described herein, the partitioning walls 120 are selectively controllable (e.g., by the control unit CU):

- in a first configuration, wherein the partitioning walls 120 are retracted with respect to the vat (container) 10, and
- in a second configuration, wherein the partitioning walls 120 extend in the container 10 and partition the container 10 in the first cell 102 and the second cell 101.

Solutions as described herein comprise partitioning walls 120 supported at a lower region of the container 10 (e.g., at the manifold 130) and selectively controllable (by the unit CU, for instance):

- in a lowered configuration, wherein the partitioning walls 120 are retracted against the lower region of the vat or container 10 (see FIG. 3A), and
- in a raised configuration, wherein the partitioning walls 120 extend upwardly in the container 10 (see FIGS. 3B, and 3C).

For instance, the walls or baffles 120 can be mounted at the bottom wall 10A of the vat 10 and exhibit a telescopic structured motorized, e.g., via pneumatic actuators (not visible for simplicity).

Other options for providing walls or baffles 120 suited to be brought in a first configuration/position and a second configuration/position as illustrated may include walls or baffles 120 having a concertina-like (bellows) structure (e.g., like blackout blinds or curtains) actuatable, e.g., via pneumatic actuators.

Still another option may include walls or baffles 120 suspended above the vat 10 and motorized, e.g., via pneumatic actuators in such a way that (in a somewhat complementary arrangement to the arrangement illustrated in the figures):

- in the first configuration or position, the baffles or walls 120 are lifted with respect to the vat 10 and do not interfere with the bath B and its interaction with the leadframes 14; and
- in the second configuration or position the baffles or walls 120 are dropped (like a stage scenery or curtain) into the bath B and define (on both sides of the leadframes 14) a compartment (cell) 101 of the inner volume of the vat 12.

The baffles or walls 120 have associated therewith (e.g., at a pressurized manifold 130 and, possibly, along their length) rows of nozzles 140 configured to be supplied with a gas (an inert gas such as nitrogen, for instance) from a source 150.

As illustrated in FIG. 3C, the nozzles 140 are intended to be supplied with pressurized gas once the walls or baffles 120 have been brought to extended (raised) configuration or position of FIG. 3B.

Once supplied with pressurized gas, the nozzles create (on both sides of the leadframes 14) two curtains of (bubbles of) gas ascending through the bath following an upwardly directed trajectory through the fraction of the bath B in the inner compartment (cell) 101 of the vat 12.

These bubble curtains may also have the effect of somehow "emptying" the inner compartment (cell) 101 of the vat 10 causing the bath B to be partly transferred from the inner (secondary) cell 101 to the two external regions 102 (main outer cell) where the anodes A are located with a possible lowering of the bath level therein as schematically indicated by an arrow in FIG. 3C.

In processing, the leadframe strip 14 may be planned to advance through the bath B with a speed such that the leadframes stay in the solder plating bath B for a time of, e.g., 3 minutes. As noted, this time of residence in the bath B will not cause undesired dissolution of the adhesion promoter layer 100.

During such "normal" operation the walls or baffles 120 are maintained in the retracted position of FIG. 3A where they do not interfere appreciably with the bath B and its interaction with the leadframes 14 so that plating may proceed as conventional in the art.

As noted, for various reasons (e.g., because the production line is stopped, e.g., to remove therefrom a leadframe strip already processed) the movement of the leadframes is halted, which results in the leadframe strip 14 being kept "dipping" for a longer time in the acidic solder bath B.

In the event of a stop longer than a certain amount of time (for instance a threshold time of, e.g., 5 minutes can be set, taking into account that dissolution of the adhesion promoter layer 100 over that time is still tolerable) the movable walls change their configuration to an extended position exemplified in FIG. 3B and the nozzles 140 are supplied with pressurized gas (e.g., an inert gas such as nitrogen).

As a result, due to the gas curtains formed by gas bubbles ascending through the bath B, the leadframe strip 14 will be practically kept dry in an inert atmosphere.

In fact, contact of the acidic medium of the plating bath B with the leadframe strip surface will be effectively countered, thus safeguarding the adhesion promoter layer 100 from the undesired effects of a prolonged exposition to an acidic medium, essentially countering the renewal of the acidic medium at surface of the leadframe strip 14.

Figure 4:
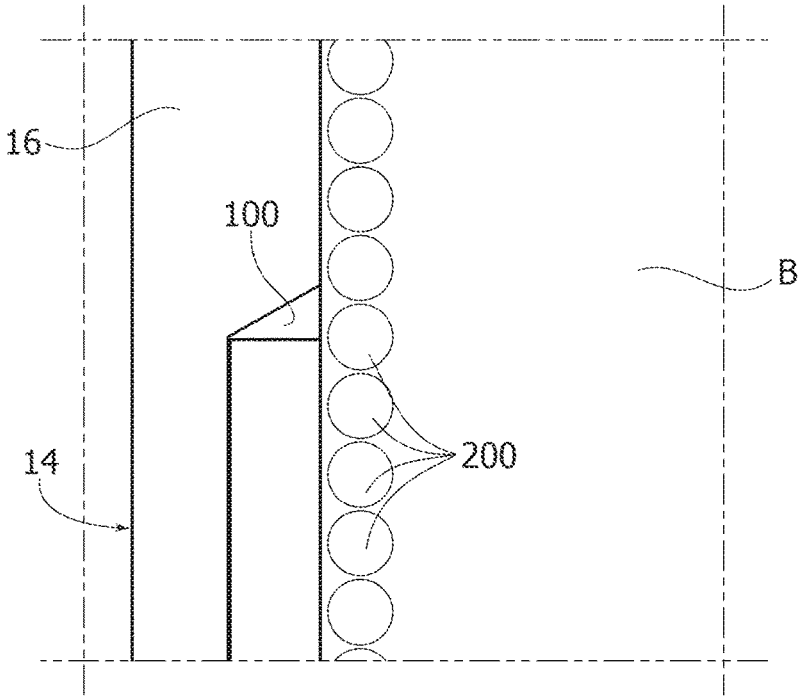
FIG. 4 is a view of the portion of FIG. 3C indicated by the arrow IV, reproduced on an enlarged scale.

This is illustrated in FIG. 4 (a portion of FIG. 3C indicated by the arrow IV represented in an enlarged scale): the leadframe 14 is shielded from the acidic medium of the bath B insofar as the (inert) gas flowing through the nozzles 140 creates a gas curtain shielding the surface of the leadframe strip 14 from the acidic medium of the bath B.

In the sequence of steps of FIGS. 3A to 3C the pump P may be kept activated and the acidic medium of the bath B free to circulate in the main outer cell 102.

As the normal operation of the plating tool is recovered (e.g., the leadframe strip is moved again through the bath B) gas supply from the nozzles 140 is discontinued and the walls or baffles 120 are returned to the retracted position of FIG. 3A, thus leaving the acidic medium to flow back to the secondary inner cell 101.

In this way normal operation of the plating equipment can be recovered.

As noted, the pump P may be kept operating (e.g., by the control unit CU) during "shielding by gas" as illustrated in FIG. 3C.

Consequently, the time for restoring normal operation is shorter in comparison with the case the pump P had to be stopped and turned out again. In fact, resuming normal operation essentially involves stopping supply of gas to the nozzles 140 and retracting the walls 120 back to a retracted position. Fast recovery of normal operation is thus facilitated.

It is again recalled that solutions as described herein can be applied, in general, to various types of tools/equipment wherein articles being treated with a processing (liquid) bath and a possible halt of the movement of the articles in the bath may result in the articles being undesirably left in prolonged contact with the bath. Processing of leadframes strip in a solder plating bath is thus merely by way of example and shall not be construed in a limiting sense of the disclosure.

Without prejudice to the underlying principles, the details and embodiments may vary, even significantly, with respect to what has been described by way of example only without departing from the extent of protection.

The extent of protection is determined by the annexed claims.

A method may be summarized as including: processing articles (14) by dipping the articles (14) in a processing bath (B) wherein the articles have opposed surfaces configured to be exposed to the processing bath (B) and applying to the articles (14) a movement through the processing bath (B), and in response to the movement of the articles (14) through the bath (B) being halted, providing a gas flow lapping the opposed surfaces of the articles (14) wherein gas flow shields said opposed surfaces from exposure to the processing bath (B).

The gas flow may be a flow of inert gas, preferably nitrogen.

The method may include: in response to the movement of the articles (14) through the bath (B) being halted, deploying partitioning walls (120) of the processing bath (B), wherein, with the partitioning walls (120) deployed, the processing bath (B) is partitioned in a first cell (102) outwardly of the deployed partitioning walls (120) and a second cell (101) inwardly of the deployed partitioning walls (120), wherein the articles (14) lie in the second cell (101) of the processing bath (B), and providing the gas flow lapping the opposed surfaces of the articles (14) within the second cell (101) of the processing bath (B).

The method may include providing said gas flow lapping the opposed surfaces of the articles (14) with a delay with respect to the movement of the articles (14) being halted.

The processed articles (14) may be substrates for semiconductor products comprising metal and resin portions with adhesion promoter material (100), and the processing bath (B) may be a plating bath, wherein the adhesion promoter material (100) is exposed to dissolution as a result of prolonged exposure to the plating bath (B).

Apparatus may be summarized as including: a container (10) configured to contain a processing bath (B) for articles (14) dipped in the processing bath (B) wherein the articles (14) have opposed surfaces configured to be exposed to the processing bath (B), the articles (14) configured to be moved along the container (10) through the processing bath (B), and a gas source (150) configured to be activated in response to the movement of the articles (14) through the bath (B) being halted to provide a gas flow lapping the opposed surfaces of the articles (14) wherein the gas flow shields said opposed surfaces from exposure to the processing bath (B).

The apparatus may include: partitioning walls (120) configured to be deployed in the container (10) in response to the movement of the articles (14) being halted, wherein, with the partitioning walls (120) deployed, the container (10) is partitioned in a first cell (102) outwardly of the deployed partitioning walls (120) and a second cell (101) inwardly of the deployed partitioning walls (120), wherein the articles (14) lie in the second cell (101) of the container (10), and the gas source (150) is configured to provide the gas flow lapping the opposed surfaces of the articles (14) within the second cell (101) of the processing bath (B).

The apparatus may include partitioning walls (120) are selectively controllable (CU): in a first configuration, wherein the partitioning walls (120) are retracted with respect to the container (10), and in a second configuration, wherein the partitioning walls (120) extend in the container (10) and partition the container (10) in said first cell (102) and said second cell (101).

The apparatus may include partitioning walls (120) supported at a lower region of the container (10) and selectively controllable (CU): in a lowered configuration, wherein the partitioning walls (120) are retracted against the lower region of the container (10), and in a raised configuration, wherein the partitioning walls (120) extend upwardly in the container (10).

The gas source (150) may be configured to provide the gas flow lapping the opposed surfaces of the articles (14) within the second cell (101) with a delay with respect to the movement of the articles (14) being halted.

The various embodiments described above can be combined to provide further embodiments. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method, comprising:

processing articles by dipping the articles in a processing bath wherein the articles have opposed surfaces configured to be exposed to the processing bath and applying to the articles a movement through the processing bath, and in response to the movement of the articles through the bath being halted, deploying partitioning walls of the processing bath from a retracted configuration to an extended configuration, wherein, with the partitioning walls deployed in the extended configuration, the processing bath is partitioned in a first cell outwardly of the deployed partitioning walls and a second cell inwardly of the deployed partitioning walls, wherein the articles lie in the second cell of the processing bath, and providing a gas flow lapping the opposed surfaces of the articles within the second cell of the processing bath, wherein gas flow shields the opposed surfaces from exposure to the processing bath.

2. The method of claim 1, wherein the gas flow is a flow of inert gas.

3. The method of claim 1, wherein the gas flow is a flow of nitrogen.

4. The method of claim 1, comprising providing the gas flow lapping the opposed surfaces of the articles with a delay with respect to the movement of the articles being halted.

5. The method of claim 1, wherein:

the processed articles are substrates for semiconductor products comprising metal and resin portions with adhesion promoter material, and the processing bath is a plating bath, wherein the adhesion promoter material is exposed to dissolution as a result of prolonged exposure to the plating bath.

6. A method, comprising:

dipping articles in a processing bath in a container, the articles have opposed surfaces exposed to the processing bath;

moving the articles along the container through the processing bath;

activating a gas source in response to moving the articles through the bath;

providing a gas flow lapping the opposed surfaces of the articles by halting the moving, the gas flow shielding the opposed surfaces from exposure to the processing bath; and deploying partitioning walls in the container in response to the moving of the articles halting, including partitioning the container in a first cell outwardly of the deployed partitioning walls and a second cell inwardly of the deployed partitioning walls, wherein the partitioning walls are selectively controllable in one of a first configuration and a second configuration, the partitioning walls are retracted with respect to the container in the first configuration, and the partitioning walls are extended in the container and partitioning the container into the first cell and the second cell in the second configuration, and the articles lie in the second cell of the container.

7. The method of claim 6, comprising partitioning walls supported at a lower region of the container and selectively controllable:

retracting, in a lowered configuration, the partitioning walls against the lower region of the container, and extending, in a raised configuration, the partitioning walls upwardly in the container.

8. The method of claim 6, wherein the gas source is configured to provide the gas flow lapping the opposed surfaces of the articles within the second cell with a delay with respect to the movement of the articles being halted.

9. A method, comprising:

moving article through a processing bath for a time period;

shielding the article with a gas flow in the processing bath after the time period while the article is in the processing bath; and deploying a partitioning wall surrounding the article and the gas flow in the processing bath after the time period while the article is in the processing bath;

wherein the partitioning wall is switchable between a retracted configuration and an extended configuration, and the partitioning wall is switched from the retracted configuration to the extended configuration to surround the article and the gas flow after the time period while the article is in the processing bath.

10. The method of claim 9, wherein the gas flow includes inert gas.

11. The method of claim 9, wherein the gas flow shielding the article in the processing bath includes forming bubbles.

12. The method of claim 9, wherein the gas flow transfers at least a part of the processing bath out of a space defined by the partitioning wall.

13. The method of claim 9, wherein the gas flow is supplied by nozzles located on the partitioning wall.

* * * * *